US006092401A

United States Patent [19]

Sankey et al.

[11] Patent Number: 6,092,401

[45] Date of Patent: Jul. 25, 2000

[54] ELECTRONIC ARTICLE SURVEILLANCE SECURITY DEVICE

[75] Inventors: James K. Sankey, Hudson; James M. Byrne, North Canton, both of Ohio

[73] Assignee: Alpha Enterprises, Inc., North Canton, Ohio

[21] Appl. No.: 09/252,177

[22] Filed: Feb. 18, 1999

[51] Int. Cl.[7] ..... E05B 73/00

[52] U.S. Cl. ..... 70/18; 24/18; 24/68 R; 70/49; 70/57.1; 70/58; 100/30; 100/34; 292/325

[58] Field of Search ..... 70/18, 30, 49, 70/57.1, 58; 292/325; 24/18, 129 R, 68 R; 206/83.5, 442; 100/30, 33 R, 34

[56] References Cited

U.S. PATENT DOCUMENTS

| | | | |
|---|---|---|---|
| 199,468 | 1/1878 | Rheubottom . | |
| 343,849 | 6/1886 | Pond | 24/129 R X |
| 394,739 | 12/1888 | Toulmin . | |
| 437,548 | 9/1890 | Anderson . | |
| 596,237 | 12/1897 | Damon | 70/18 |
| 639,196 | 12/1899 | Fehling | 70/49 |
| 673,612 | 5/1901 | Appleby | 70/49 |
| 886,905 | 5/1908 | Ward . | |
| 895,403 | 8/1908 | Jackson . | |
| 1,083,612 | 1/1914 | Hooker | 70/18 |
| 1,124,130 | 1/1915 | Grant | 24/18 |
| 1,141,245 | 6/1915 | Gillespie | 24/18 |
| 1,165,320 | 12/1915 | Clary | 24/18 |
| 1,165,816 | 12/1915 | Tichenor | 24/18 |
| 1,657,190 | 1/1928 | Ballou . | |
| 1,992,868 | 2/1935 | Krause | 292/325 |
| 2,002,946 | 5/1935 | Jacobs | 241/5 |
| 3,395,555 | 8/1968 | Hickman | 70/39 |
| 3,466,668 | 9/1969 | Ochiai | 2/322 |
| 3,568,902 | 3/1971 | Highberger | 70/58 X |
| 3,611,760 | 10/1971 | Muther | 70/58 |
| 3,831,407 | 8/1974 | Coleman | 70/18 |
| 3,906,758 | 9/1975 | Hurwitt | 70/30 |
| 4,004,440 | 1/1977 | Dreyer | 70/58 X |
| 4,071,023 | 1/1978 | Gregory | 128/133 |
| 4,086,795 | 5/1978 | Foster et al. | 70/233 |
| 4,418,551 | 12/1983 | Kochackis | 70/18 |
| 4,756,171 | 7/1988 | Homar | 70/18 |
| 4,896,517 | 1/1990 | Ling | 70/18 |
| 4,930,324 | 6/1990 | Meier | 70/18 |
| 4,949,679 | 8/1990 | Wolfer | 119/96 |
| 5,144,821 | 9/1992 | Ernesti et al. | 70/159 |
| 5,156,028 | 10/1992 | Jiang | 70/30 |
| 5,193,368 | 3/1993 | Ling | 70/30 |
| 5,345,947 | 9/1994 | Fisher | 128/878 |
| 5,379,496 | 1/1995 | Krauss | 24/625 |
| 5,517,836 | 5/1996 | Hong | 70/30 |
| 5,551,447 | 9/1996 | Hoffman et al. | 128/869 |
| 5,581,853 | 12/1996 | Miller et al. | 24/302 |
| 5,671,506 | 9/1997 | Eliasson | 24/19 |
| 5,687,455 | 11/1997 | Alexander | 24/16 |
| 5,687,456 | 11/1997 | Chang | 24/16 PB |
| 5,722,266 | 3/1998 | Yeager et al. | 70/57 |

FOREIGN PATENT DOCUMENTS

| | | | |
|---|---|---|---|
| 620381 A1 | 10/1994 | European Pat. Off. | 24/68 R |
| 123470 | 11/1948 | Germany . | |
| 27 25 580 | 12/1977 | Germany . | |

*Primary Examiner*—Lloyd A. Gall
*Attorney, Agent, or Firm*—Sand & Sebolt

[57] ABSTRACT

A security device affixable to a package includes a housing, a strap, and a crossover connector carried by a cable. The strap is formed with a toothed channel containing a plurality of teeth that lockingly engage with a plurality of locking fingers formed on the housing. The strap is selectively and slidably received within the housing and cannot be removed without the use of a special key. When the key is inserted into the housing, the pins of the key simultaneously deflect the locking fingers out of locking engagement with the teeth of the toothed channel, thus permitting the strap to be removed from the housing. The cable and crossover connector are configured such that the cable is in a figure-8 configuration, thus permitting a single cable to carry the housing and the strap of the security device, and further permitting a single cable to extend across all six surfaces of the parallelepiped package.

13 Claims, 10 Drawing Sheets

ELECTRONIC ARTICLE SURVEILLANCE SECURITY DEVICE

BACKGROUND OF THE INVENTION

1. Technical Field

The invention generally relates to article security devices used in retail stores. More particularly, the invention relates to a security device that wraps around a box and is adjustable to easily accommodate different-sized boxes. Specifically, the invention relates to an electronic article surveillance (EAS) security device that includes a cooperating strap and housing carried on a cable whereby the cable is wrapped about the article to be protected and locked in place when the strap is inserted into the housing; the strap having a plurality of locking teeth allowing the device to accommodate different-sized articles.

2. Background Information

Retail stores have a difficult time protecting small boxed merchandise from theft. The problem is significant when the merchandise is relatively small but expensive items such as electronic gadgets. Customers often wish to visually inspect these expensive articles prior to purchase. The store is thus faced with the problem of protecting these expensive articles from theft while also displaying them for sale in a manner that is pleasing to the customer. One method employed to protect such articles is to display the article in a display case that can only be accessed from behind a counter by store personnel. In this situation, a customer can view the article through the glass but cannot handle the article unless a store clerk removes the article from the case. A problem arises in large retail stores in moving merchandise from the display area to the checkout area without subjecting the merchandise to theft. One manner is to maintain a supply of the boxes containing the expensive articles or merchandise close at hand for delivery to or pickup by the customer for subsequent taking to a checkout clerk. However, this makes the boxes susceptible to theft.

Another method used by retail stores is to list articles in a catalog and require consumers to place an order from the catalog. The article is then delivered from a back storage area and the consumer picks up and pays for the merchandise at the same location thus preventing theft of the article. The consumer usually cannot inspect the actual purchased article before paying, and must undergo the hassle of returning the article for a refund if later unsatisfied.

Prepackaged computer software is particularly subject to theft because it is sold on a small item of recorded media such as a 32 inch disc or a compact disc. Computer software typically is sold in a box that is displayed on a shelf. One popular software box is 8 inches wide and 92 inches tall. The thicknesses of these boxes range between one and five inches depending on the contents. The range of thicknesses causes the circumference of the software boxes to vary greatly. The range is large enough that retail stores currently must use different-sized security devices for different boxes. This practice is undesired and has created a demand for a security device that can be adjusted to fit on all software boxes. It is also desired in the art to provide a security device that secures such boxes in a closed condition so that the software cannot be removed from the box. It is further desired that the security device carry an EAS tag.

SUMMARY OF THE INVENTION

In view of the foregoing, an objective of the invention is to provide a security device that wraps around an article such as a box and can accommodate different-sized boxes.

Another objective of the invention includes providing a security device that requires a special tool to unlock the device.

Another objective of the invention includes providing a security device that encloses a rectangular object on all six sides.

Another objective of the invention is to provide a security device that can be reused.

Another objective of the invention is to provide a security device that does not add significant size or weight to the package.

Another objective of the invention is to provide a security device that can be fabricated from conventional plastic and wire materials that are not readily affected by chemicals and moisture.

Another objective of the invention includes providing a security device for use with articles offered for sale in retail venues.

Another objective of the invention includes providing an improved security device capable of being secured to rectangular cartons having a standard profile and a range of thicknesses in a manner that prevents access to the cartons.

Another objective of the invention includes providing an improved security device that carries an EAS tag in an inconspicious manner to detect unauthorized removal of the security package from a retail store.

Another objective of the invention includes providing an improved security device having a smooth housing without edges, lips, grooves, or other pry points thereby making disablement and/or destruction of the housing difficult.

Another objective of the invention includes providing an improved security device that includes a strap having a plurality of teeth, a housing having a ratcheting mechanism, the strap and the housing being slidably adjustable with each other to enable the security device to secure a variety of packages in a range of sizes.

Another objective of the invention includes providing an improved security device that includes a locking mechanism within the housing where the locking mechanism prohibits removal of a strap held therein without the use of a special tool.

Another objective of the invention includes providing an improved security device that includes a releasable locking mechanism within the housing that provides substantially the same protection as security packages having non-releasable locking mechanisms.

Another objective of the invention includes providing a security device utilizing a crossover connector that permits a single length of cable to be used with the device.

Another objective of the invention includes providing an improved security device that is of simple construction, that achieves the stated objectives in a simple, effective, and inexpensive manner, and that solves problems and satisfies needs in the art.

These and other objectives and advantages are obtained by the improved security package of the invention, the general nature of which may be stated as including a cable, a housing attached to the cable, the housing having an entry port and an exit port, a locking mechanism carried by the housing between the entry port and the exit port, a strap attached to the cable, the strap having a toothed surface containing a plurality of teeth for selective interaction with the locking mechanism, the strap being selectively insertable within the housing in the direction from the entry port to the exit port, the strap being selectively prohibited from removal from the housing once the teeth operatively engage the locking mechanism, and a crossover connector formed with a pair of passages, the cable extending through both of the passages to carry the crossover between the housing and the strap.

BRIEF DESCRIPTION OF THE DRAWINGS

The preferred embodiment of the invention, illustrative of the best mode in which applicant contemplated applying the principles of the invention, is set forth in the following description and is shown in the drawings and is particularly and distinctly pointed out and set forth in the appended claims.

Similar numerals refer to similar parts throughout the specification.

DESCRIPTION OF THE PREFERRED EMBODIMENT

The security device of the present invention is indicated generally by the numeral 2 in the accompanying drawings. Security device 2 wraps around and secures all six faces of a parallelepiped package 3 in an adjustable manner. Package 3 may be any of a variety of sizes known and understood in the relevant art. Security device 2 may also be used with packages that are not rectangular.

Figure 2:
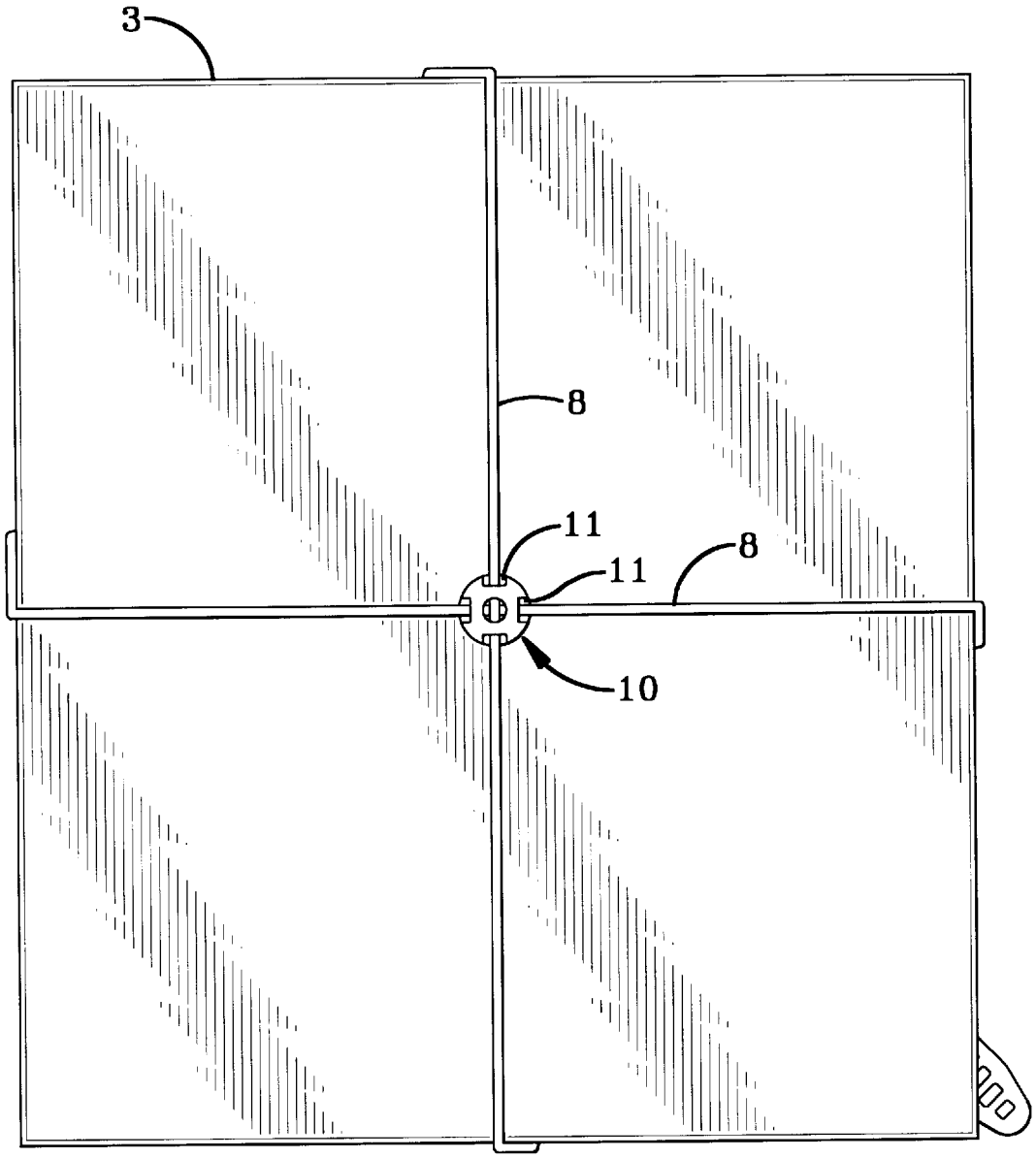
FIG. 2 is a front elevational view of the crossover connector of the security device of the present invention.

Security device 2 includes a housing 4, a strap 6, a cable 8, and a crossover connector 10. Cable 8 terminates with a pair of substantially cylindrical end blocks 9, although end blocks 9 may be of non-cylindrical shapes without departing from the spirit of the invention. Cable 8 is a strong, flexible, elongated item that may contain steel fibers and/or glass fibers for strength, and may additionally be coated with a plastic or rubber compound. Crossover connector 10 is formed with a pair of passages 11 through which cable 8 extends. As shown in FIG. 2, passages 11 are substantially perpendicular to one another such that when cable 8 extends through passages 11, cable 8 is in a figure-8 configuration.

Figures 11, 16:
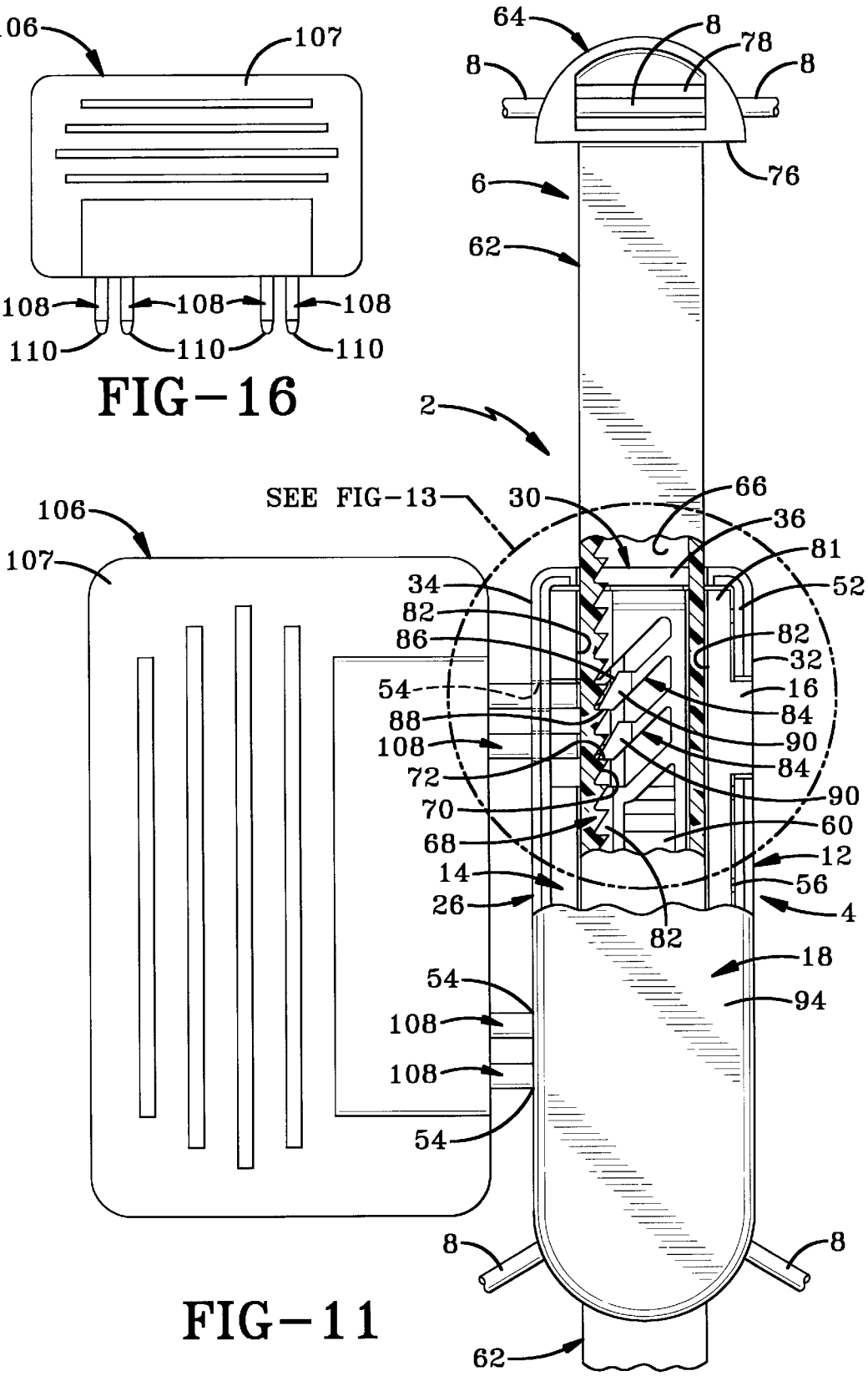
FIG. 11 is a top plan view, partially in section, showing insertion of the key into the keyways of the housing.
FIG. 16 is a front elevational view of the key.

Housing 4 includes a base 12 formed with a cavity 13 configured to hold a locking mechanism 14 connected to base 12 with a pair of hinges 16. Housing 4 additionally includes a cover 18 that is fixedly attached to base 12 after locking mechanism 14 has been positioned inside cavity 13. In accordance with the objectives of the present invention, housing 4 includes a channel 20 therethrough that selectively receives strap 6 therein, as will be set forth more fully below. In operation, strap 6 is selectively inserted into channel 20 and is selectively held therein until a key 106 (FIG. 16) is used to release strap 6 so that strap 6 can be removed from housing 4 and security device 2 removed from package 3.

Base 12 includes a bottom plate 22 having a plate surface 24. A wall 26 extends perpendicularly outward from plate surface 24 at the periphery of bottom plate 22. Wall 26 includes a rounded wall 28 and a flat end wall 30 at opposite ends of base 12. Wall 26 additionally includes a hinge wall 32 and a keyway wall 34 that extend between rounded wall 28 and flat end wall 30. Hinges 16 connect between hinge wall 32 and locking mechanism 14.

Flat end wall 30 is formed with an entry port 36 therethrough of substantially rectangular section configured to receive strap 6. Rounded wall 28 is likewise formed with an exit port 38 of substantially similar configuration to entry port 36 but additionally containing a tang 40 extending into exit port 38, as will be discussed further below.

Rounded wall 28 includes a pair of cable openings 42 that are configured to receive cable 8 therein. A cable guide 44 extends inwardly from the inner surface of rounded wall 28 adjacent each cable opening 42 to form a cable channel 45 capable of receiving cable 8 therein. Cable guides 44 terminate at substantially planar retention surfaces 46 against which end blocks 9 of cable 8 rest (FIG. 6) when housing 4 is fully assembled. Each cable guide 44 additionally is formed with a cutout 48 that is aligned between entry port 36 and exit port 38 (FIGS. 3, 6) and is included by channel 20. Bottom plate 22 additionally is formed with a pair of relief surfaces 50 of substantially spherical section in which end blocks 9 are disposed, although relief surfaces 50 could be of substantially any shape necessary to provide clearance below end blocks 9.

Figure 3:
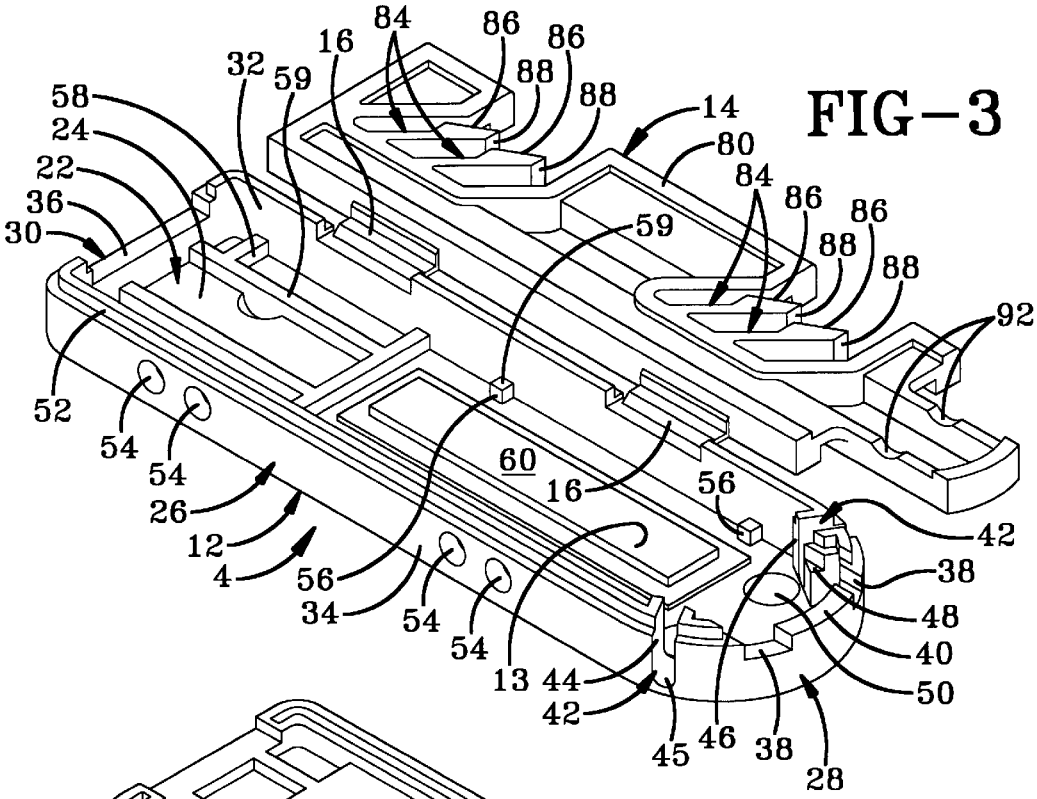
FIG. 3 is a perspective view of the base and locking mechanism of the security device of the present invention.
Figure 4:
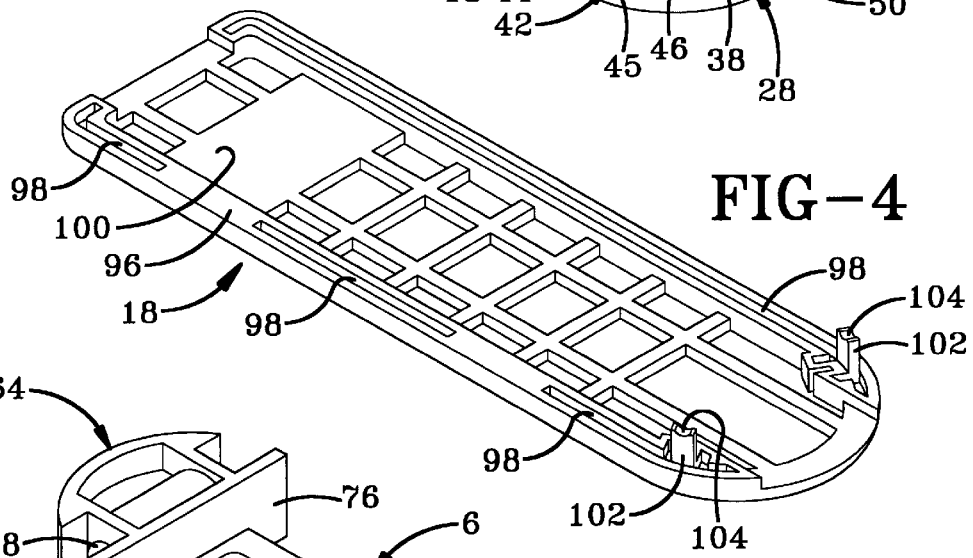
FIG. 4 is a perspective view of the cover of the security device of the present invention.
Figure 5:
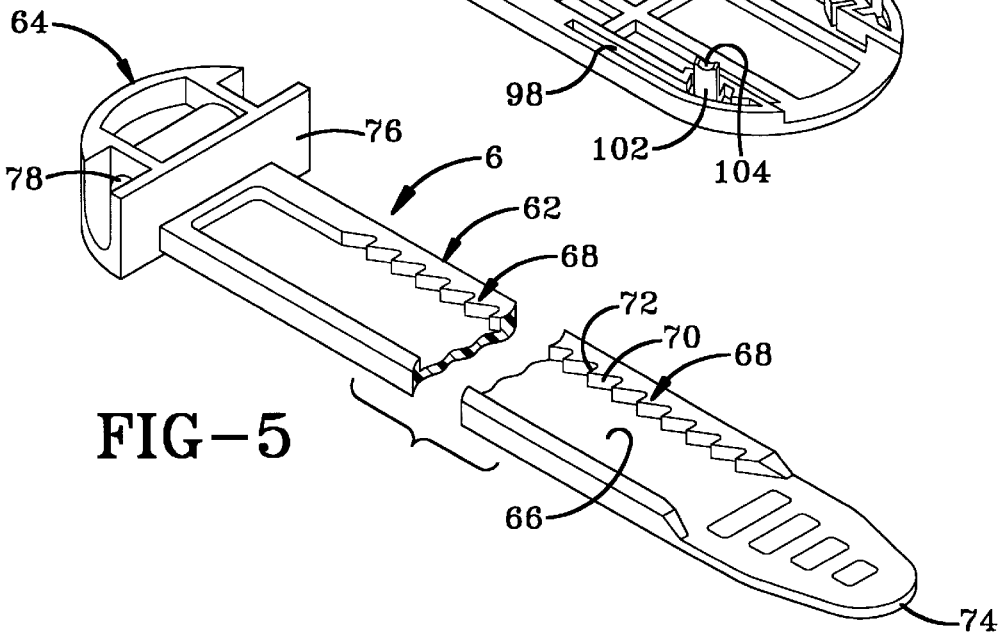
FIG. 5 is a perspective view of the strap of the security device of the present invention.

Wall 26 is formed with a connection ridge 52 upstanding from an upper edge thereof. Connection ridge 52 assists in fixedly connecting cover 18 to base 12. As is best shown in FIG. 3, connection ridge 52 extends substantially about the perimeter of wall 26, but does not extend across entry port 36, exit port 38, cable openings 42, or the regions along hinge wall 32 where hinges 16 connect.

Keyway wall 34 is formed with a plurality of substantially cylindrical keyways 54 that are parallel and spaced apart from one another. As will be set forth more fully below, keyways 54 are configured to receive key 106 to release strap 6 from housing 4, permitting security device 2 to be removed from package 3.

Base 12 is additionally formed with a plurality of support blocks 56 and a support body 58 formed between wall 26 and plate surface 24. Support blocks 56 and support body 58 each include an upper surface 59 disposed in a common imaginary plane upon which locking mechanism 14 is supported. Support blocks 56 preferably extend only a relatively small way into cavity 13, thus providing a sufficiently large area on plate surface 24 where an electronic article surveillance (EAS) tag 60 can be mounted.

As is understood in the relevant art, EAS tag 60 is a device that trips an alarm when removed from the perimeter of a secured area, such as the interior regions of a retail establishment. EAS tag 60 thus prevents the unauthorized removal of security device 2 from the retail establishment without triggering an associated alarm system.

Strap 6 includes a elongated strap body 62 connected with a head 64. Strap body 62 and head 64 are preferably formed integrally of a tough material having a flexible characteristic. Strap body 62 includes upper and lower surfaces, one of which is formed with a toothed channel 66 containing a plurality of teeth 68 extending into toothed channel 66. Each tooth 68 includes an angled entry surface 70 and a transverse locking surface 72. Strap body 62 terminates at a free end 74 that is preferably rounded or tapered to facilitate the insertion of strap 6 into channel 20.

Head 64 of strap 6 includes a substantially planar flat face 76 and is formed with a substantially cylindrical cable bore 78 therethrough. Cable bore 78 receives cable 8 therein. Flat face 76 is configured to rest flush against flat end wall 30 of base 12 when strap 6 is inserted to its fullest extent into channel 20.

Locking mechanism 14 includes a lower surface 80 and an upper surface 81 opposed thereto. Locking mechanism 14 is sized and configured to fit inside cavity 13 when rotated about hinges 16. Locking mechanism 14 and base 12 are preferably formed as an integral one-piece plastic member, most preferably of a high-impact and rugged polymer having some flexibility characteristics.

Figure 6:
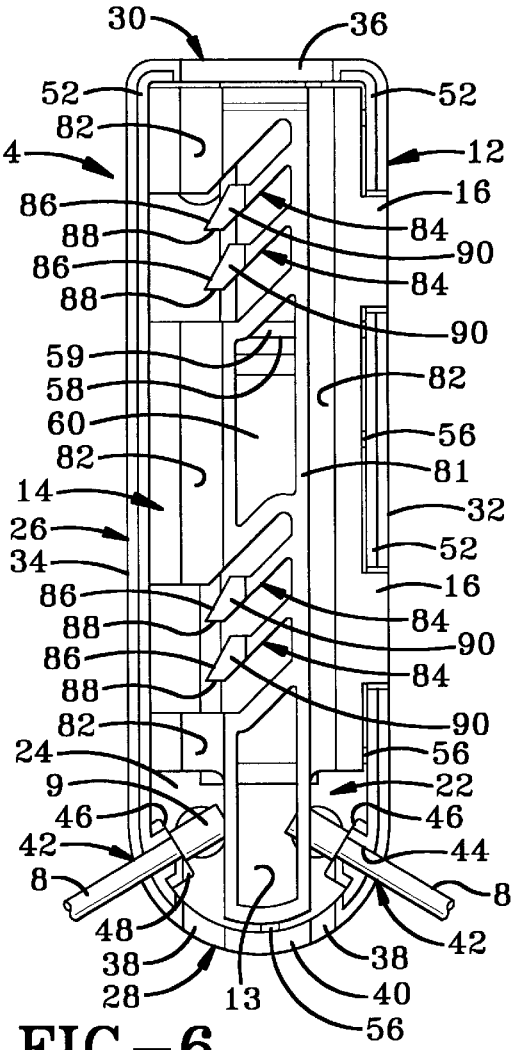
FIG. 6 is a top plan view of the housing prior to installation of the cover.
Figure 7:
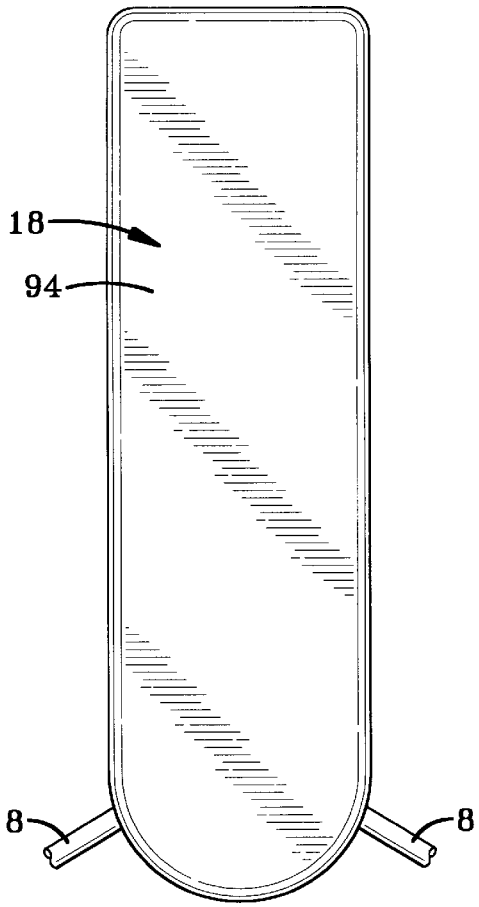
FIG. 7 is a top plan view of the assembled housing.

Lower surface 80 of locking mechanism 14 rests flush against support surface 59 which thus retains locking mechanism 14 in a fixed position with respect to base 12. Upper surface 81 is formed with a lock channel 82 that is configured to cooperatively receive toothed channel 66 thereon. As is best shown in FIG. 6, lock channel 82 is aligned with entry port 36 and exit port 38 when locking mechanism 14 is installed in cavity 13 against support surface 59 such that channel 20 includes lock channel 82.

Figure 12:
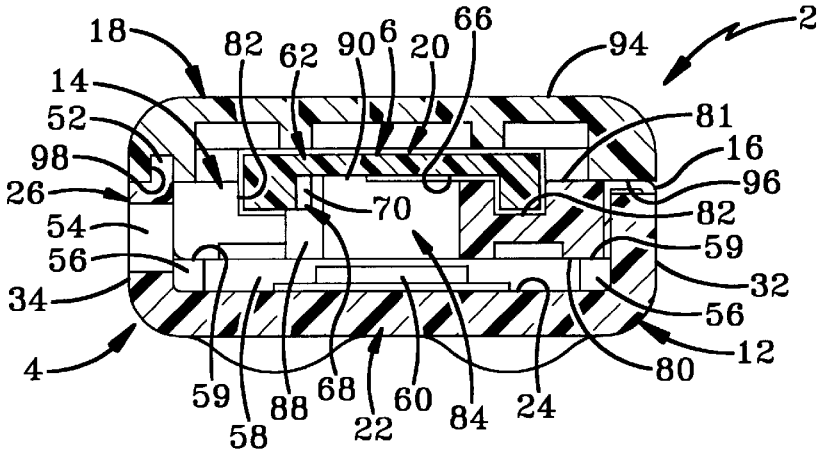
FIG. 12 is a sectional view of the security device taken along line 12—12 of FIG. 9.

Locking mechanism 14 is additionally formed with a plurality of flexible locking fingers 84. Locking fingers 84 are tilted in the direction from entry port 36 toward exit port 38 with each containing an angled face 86 and a lock face 88. Each locking finger 84 additionally contains a protruding portion 90 extending outwardly therefrom (FIG. 12) that is configured to extend into toothed channel 66 when strap 6 is received in lock channel 82, as will be set forth more fully below. Locking mechanism 14 additionally contains a pair of indentations 92 formed on lower surface 80 to provide clearance between locking mechanism 14 and end blocks 9 when housing 4 is fully assembled.

Cover 18 includes an outer surface 94 and an inner surface 96 opposed thereto. Inner surface 96 is formed with a connection cutout 98 about its periphery that cooperatively receives connection ridge 52 of wall 26 therein. Inner surface 96 is additionally formed with a lid channel 100 that aligns with lock channel 82 of locking mechanism 14 and is included by channel 20 when cover 18 is installed on base 12. Cover 18 additionally includes a pair of cable clamps 102 protruding outwardly from inner surface 96. Each cable clamp 102 terminates at a curved surface 104. Cable clamps 102 are configured to be received with minimal clearance in cable channels 45 when cover 18 is installed onto base 12. In this regard, curved surfaces 104 are configured to provide only sufficient clearance between themselves and cable channels 45 to allow cable 8 to be received therebetween.

Key 106 (FIG. 6) includes a handle 107 from which protrude a plurality of pins 108. Pins 108 are of a substantially circular cross-section and are configured in size, shape, and number to be received in keyways 54 of keyway wall 34. Each pin 108 terminates at a rounded tip 110 that can be operatively engaged with angled faces 86 of locking fingers 84.

Security device 2 is assembled by first passing cable 8 through cable bore 78 of strap 6 such that strap 6 is located at approximately the midsection of cable 8. Crossover connector 10 is then installed onto cable 8 by passing one end block 9 through each passage 11. The ends of cable 8 are then installed in cable openings 42 of base 12 such that end blocks 9 rest against retention surfaces 46. Locking mechanism 14 is then rotated about hinges 16 until lower surface 80 rests against support surface 59 such that locking mechanism 14 resides inside cavity 13. Cover 18 is then installed over base 12 such that connection ridge 52 atop wall 26 operatively engages connection cut out 98 formed on cover 18 and cable clamps 102 of cover 18 are disposed within cable channels 45. In such configuration, end blocks 9 are retained within housing 4 against retention surfaces 46 and between relief surfaces 50 and indentations 92, and cable 8 is disposed between curved surfaces 104 and cable channels 45. It is preferred that cover 18 be fixedly attached to base 12 by known means such as ultrasonic welding or through the use of appropriate adhesives.

Figure 1:
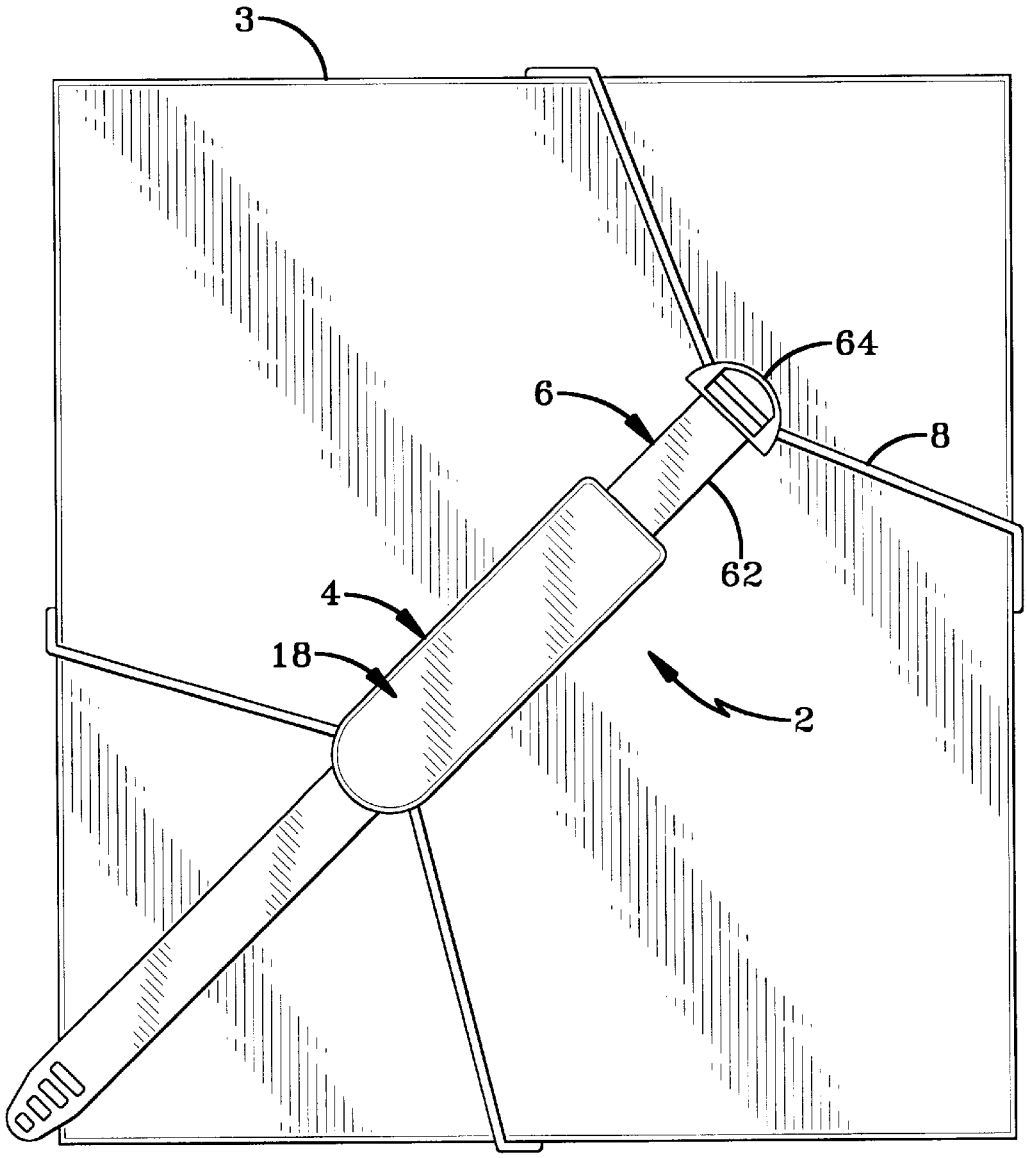
FIG. 1 is a front elevational view of the security device of the present invention locked around a box.
Figure 8:
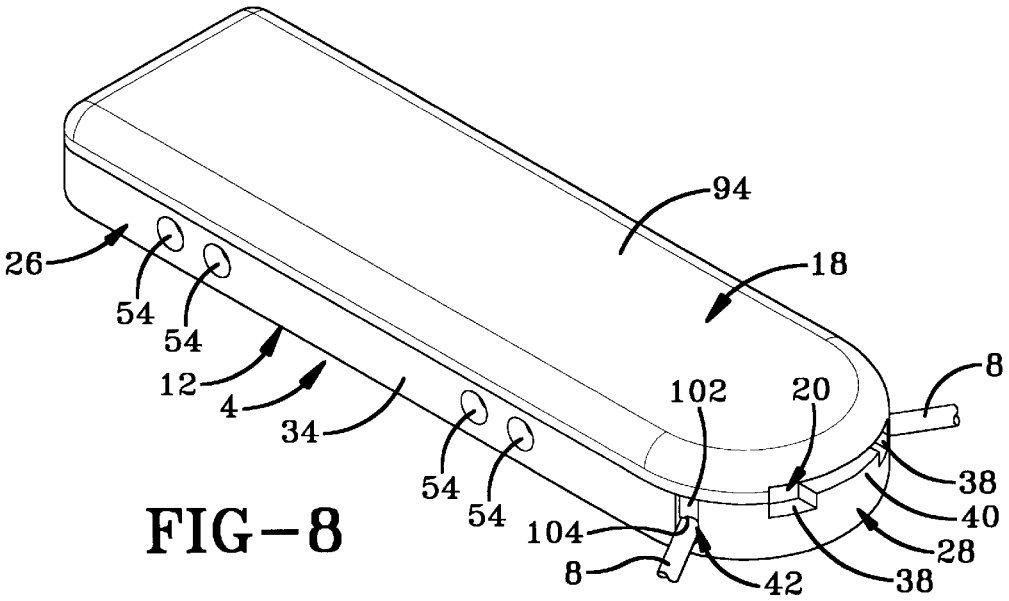
FIG. 8 is a perspective view of the assembled housing of the security device of the present invention
Figure 9:
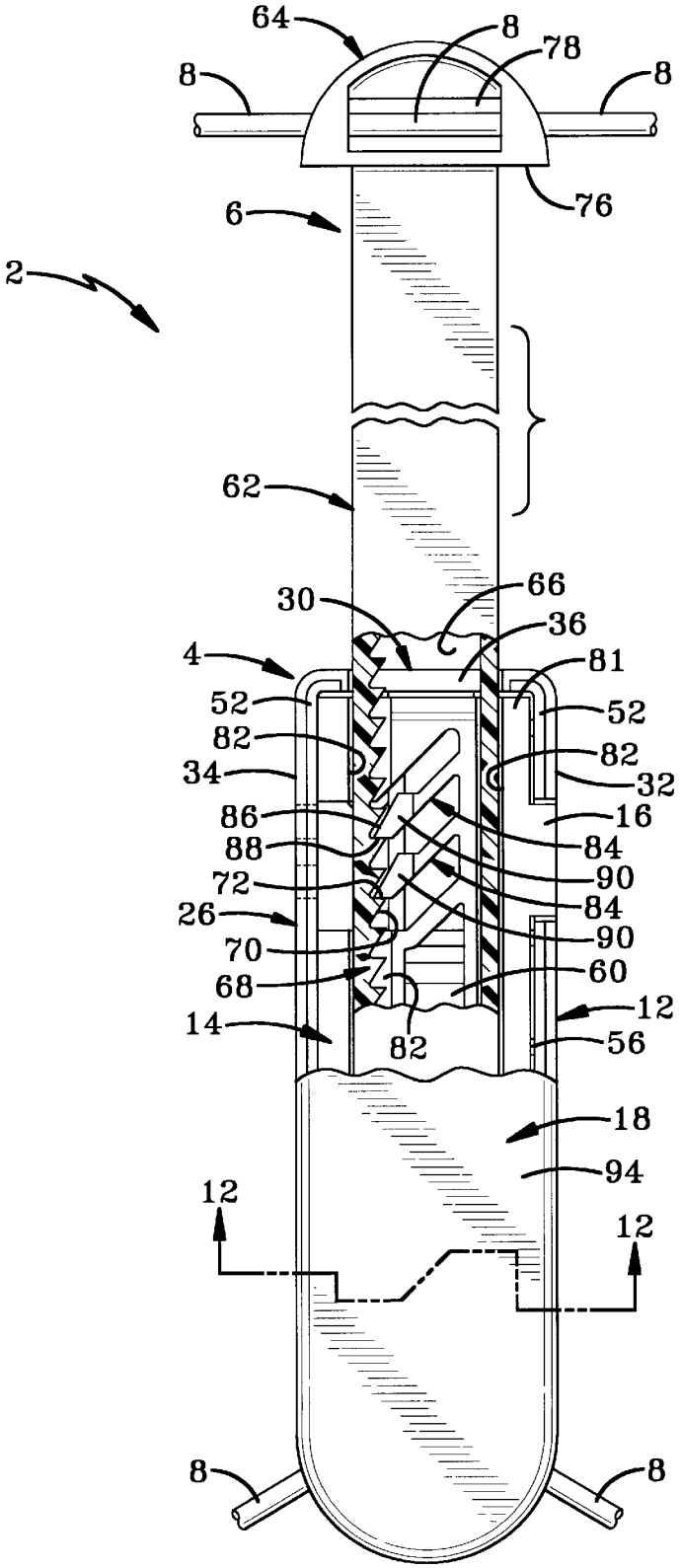
FIG. 9 is a top plan view, partially in section, showing the strap being initially inserted into the housing.
Figure 10:
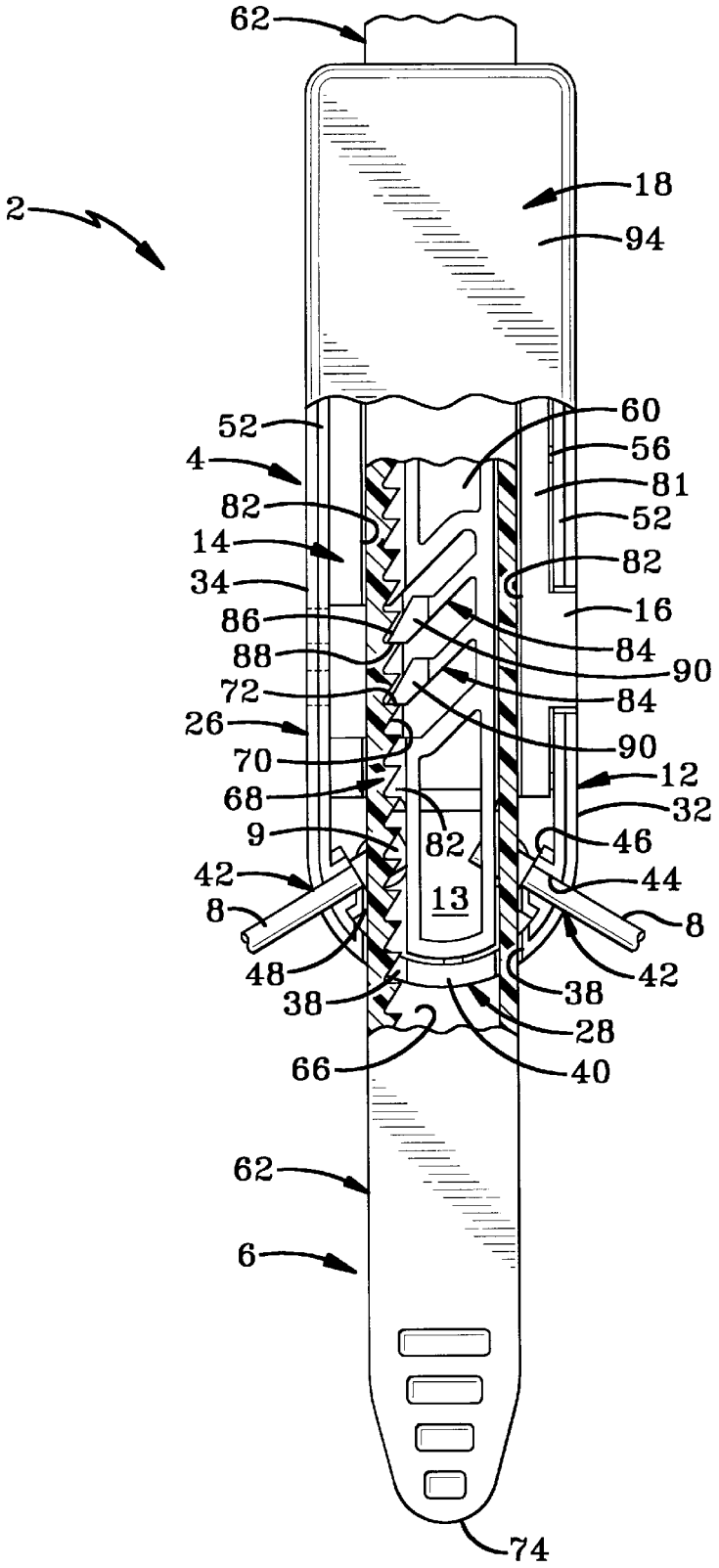
FIG. 10 is a top plan view, partially in section, showing the strap inserted through the housing to the adjusted position.

When security device 2 is assembled as set forth above, cable 8 is in a figure-8 configuration and crossover connector 10 is interposed along cable 8 between housing 4 and strap 6. As is best shown in FIGS. 1 and 2, security device 2 is installed on package 3 such that housing 4 and strap 6 lay along a major panel of package 3, with crossover connector 10 resting against the opposite major panel thereof.

As can be seen from the foregoing, channel 20 includes entry port 36, exit port 38, cutouts 48, lock channel 82, and lid channel 100. Strap body 62 of strap 6 is selectively and slidably received within channel 20 with little clearance therebetween.

Figure 13:
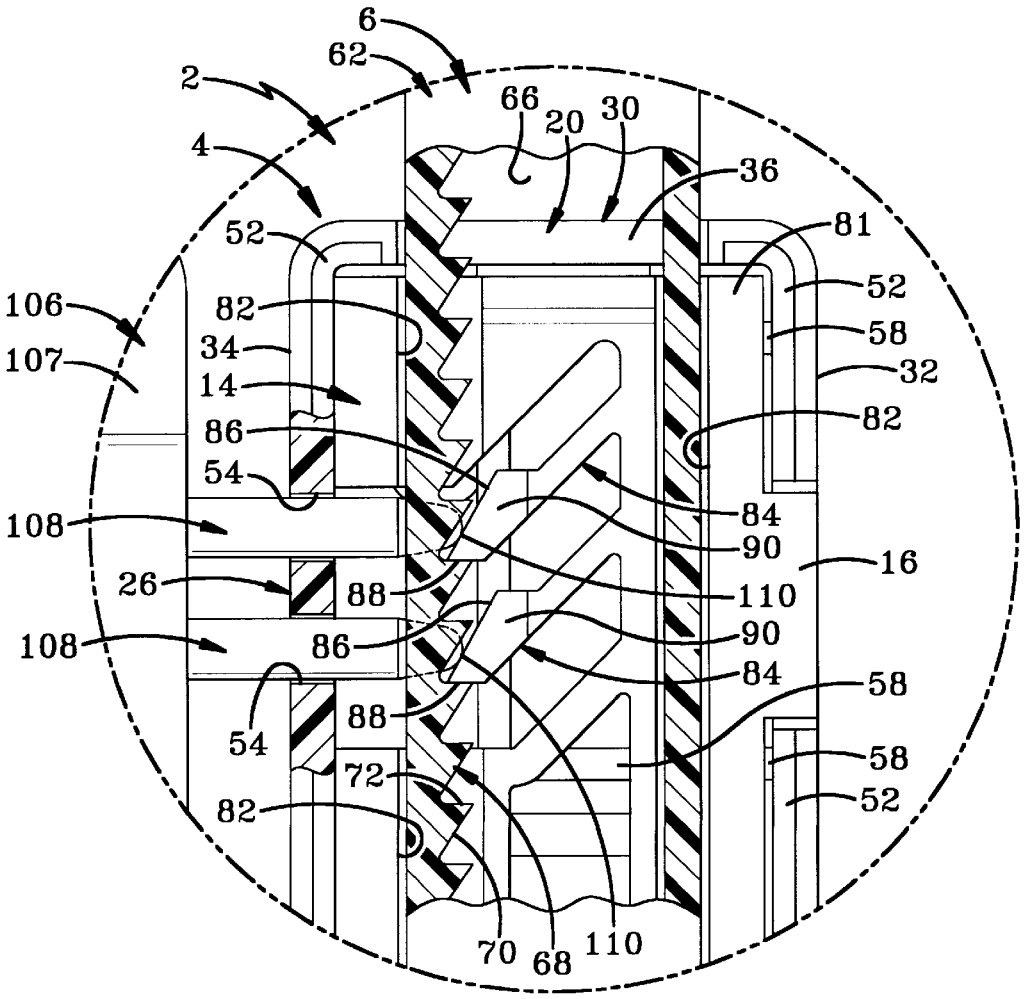
FIG. 13 is an enlarged view of the encircled portion of the security device shown in FIG. 11.

In accordance with the objectives of the present invention, locking fingers 84 of locking mechanism 14 are shaped and configured to selectively lockingly engage teeth 68 of toothed channel 66 when strap body 62 is inserted through channel 20. As strap body 62 is incrementally inserted into entry port 36, angled entry surfaces 70 of teeth 68 engage angled faces 86 of locking fingers 84, thus deflecting locking fingers 84 away from teeth 68 until transverse locking surfaces 72 pass lock faces 88, at which point locking fingers 84 return to their undeflected position as depicted in FIG. 13. When locking fingers 84 are operatively engaged with teeth 68, lock faces 88 lockingly engage transverse locking surfaces 72, thus preventing strap 6 from being removed from housing 4 in the direction of entry port 36 without the use of key 106. Additionally, when strap body 62 is received within channel 20, protruding portion 90 of each locking finger 84 protrudes into toothed channel 66 such that strap body 62 is tightly interposed between protruding portions 90 and lid channel 100, thus inhibiting the insertion of picks into housing 4 by unauthorized persons in an attempt to remove security device 2 from package 3.

Security device 2 is installed on package 3 by wrapping cable 8 around package 3 such that crossover connector 10 lays against one of the major panels of package 3 and slidingly inserting free end 74 of strap body 62 into entry port 36. Strap body 62 is slidingly inserted into entry port 36 of housing 4 until the slack is removed from cable 8. In such condition, cable 8 wraps about the six faces of package 3, thus preventing package 3 from being opened. Additionally, inasmuch as housing 4 contains EAS tag 60, an attempt to remove package 3 containing security device 2 thereon from the retail premises will cause the alarm system to be tripped by EAS tag 60. In accordance with the objectives of the present invention, therefore, security device 2 prevents package 3 from being opened or removed from the retail premises.

Figure 14:
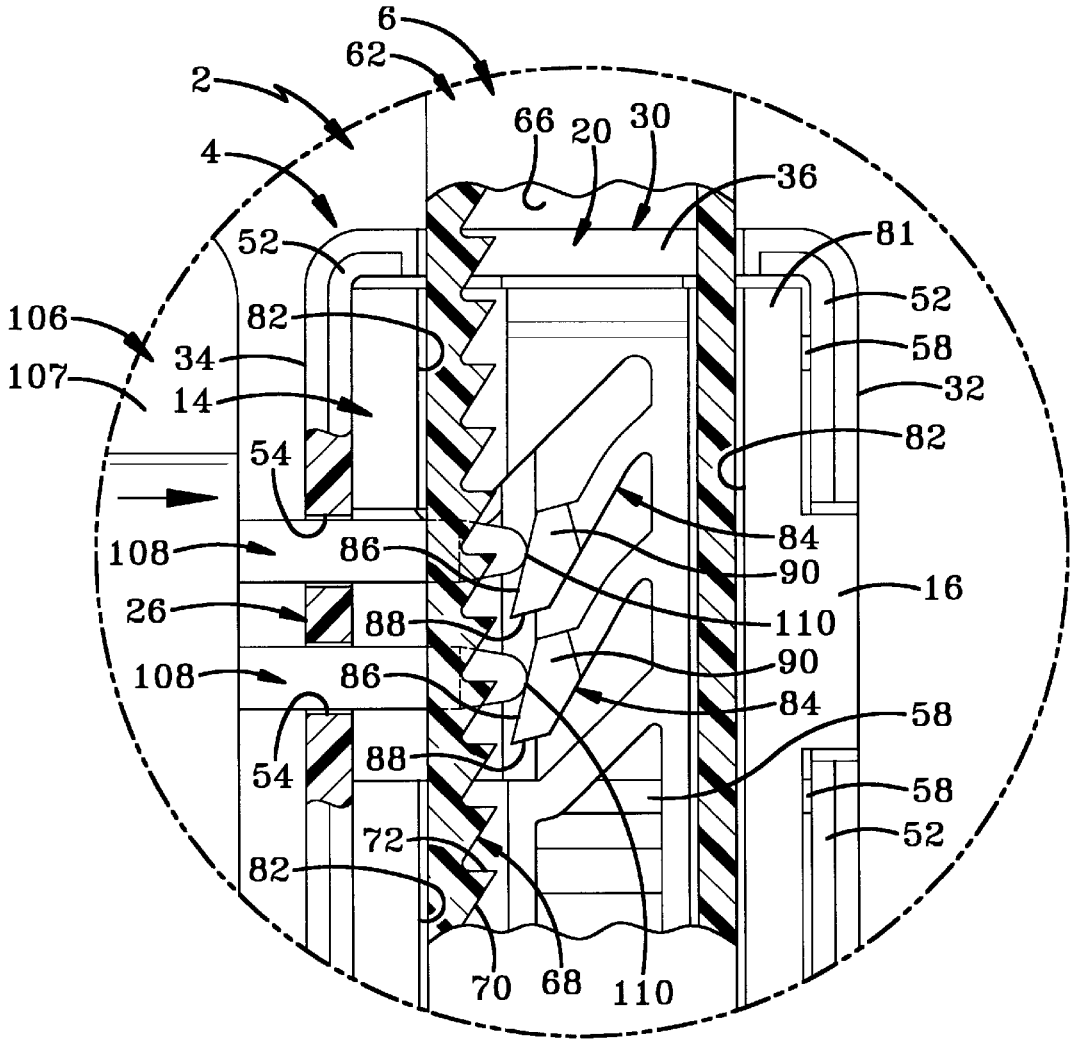
FIG. 14 is a view similar to FIG. 13 depicting the pins of the key moving the locking fingers of the locking mechanism to an unlocked position.
Figure 15:
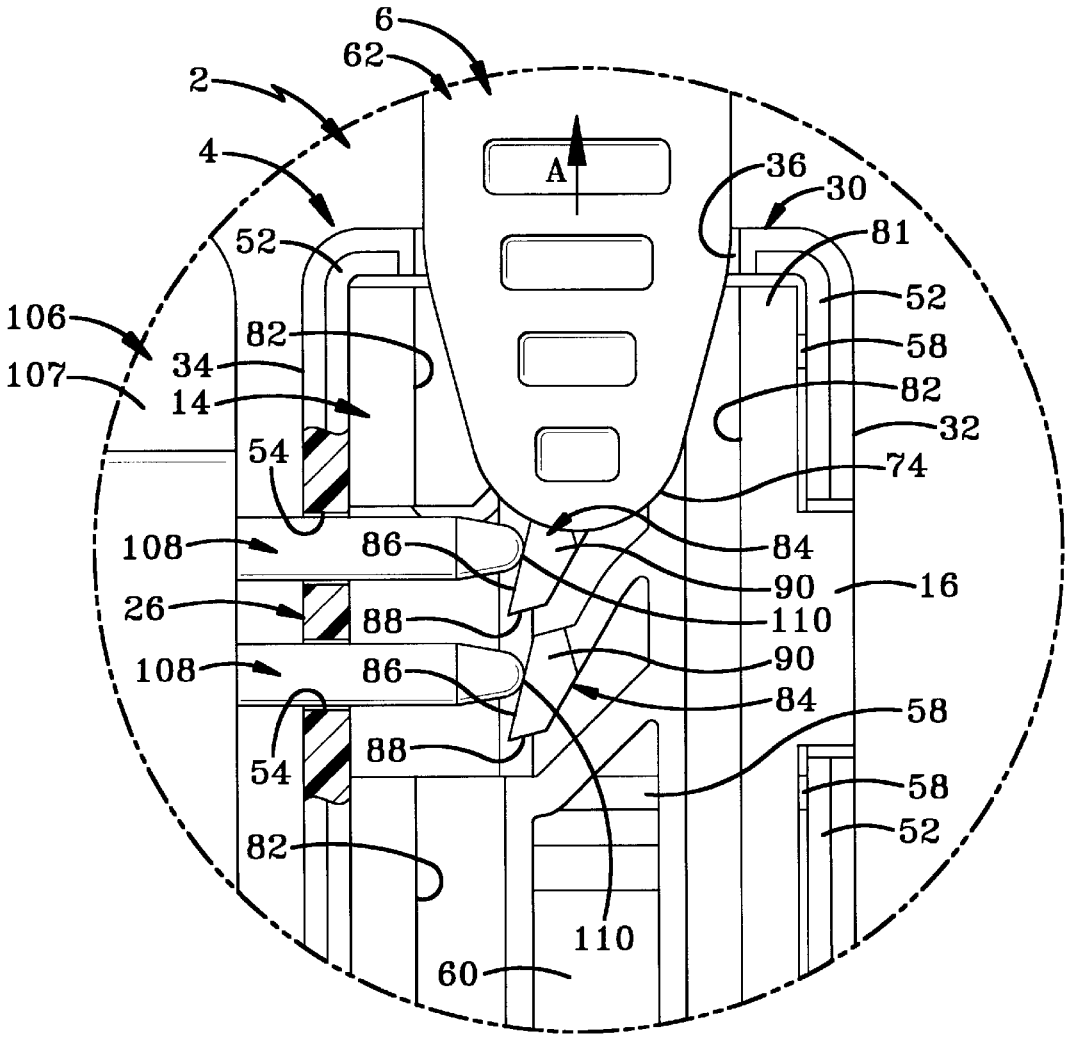
FIG. 15 is a view similar to FIGS. 13 and 14 depicting the removal of the strap from the housing upon movement of the locking fingers to the unlocked position.

Security device 2 is removed from package 3 only with the use of key 106. As is best shown in FIGS. 9–11 and 13–15, each keyway 54 formed in keyway wall 34 corresponds with a locking finger 84. As was indicated hereinbefore, keyways 54 are sized and shaped to slidingly receive pins 108 of key 106 therein. As can be seen in FIGS. 11 and 13–15, tips 110 of pins 108 engage angled faces 86 of locking fingers 84 and deflect locking fingers 84 from an undeflected position to a deflected position when key 106 is inserted into housing 4. In accordance with the objectives of the present invention, and as can be seen in FIGS. 14–15, pins 108 simultaneously move each locking finger 84 out of locking engagement with teeth 68, thus permitting strap body 62 to be removed from housing 4 in the direction of entry port 36 as is depicted by the arrow A in FIG. 15. Security device 2 can then be reused by installing it on another package 3.

In accordance with the objectives of the present invention, and as can be seen in FIG. 1, housing 4 can be placed at a variety of positions along strap 6, thus permitting security device 2 to fit a variety of sizes of packages 3. Further in accordance with the objectives of the present invention, crossover connector 10 causes cable 8 to be in a figure-8 configuration, thus permitting a single cable 8 to carry both housing 4 and strap 6 and to lay across all six faces of package 3. As is understood in the relevant art, the failure or breakage of a device containing a housing and a cable attached thereto typically occurs at the point at which the cable connects with the housing, not in the cable itself. As such, the use of a single cable 8 in security device 2 results in only two points at which cable 8 terminates at housing 4, specifically, at retention surfaces 46. The configuration of security device 2 with only a single cable 8 thus minimizes the likelihood that security device 2 may be broken or otherwise fail through usage.

In accordance with the objectives of the present invention, cable openings 42 are positioned on rounded wall 28 at an angle in approximately the range of 110°–160° apart from one another, although they could be separated at angles greater and lesser without departing from the spirit of the present invention. The positioning of cable openings 42 in such fashion minimizes the twisting and bending stress on cable 8 at the point it exits cable channels 45 inasmuch as cable 8 must wrap around package 3, as is depicted in FIG. 1, thus further minimizing the likelihood of failure at the point of connection between cable 8 and housing 4.

Accordingly, the improved electronic article surveillance security system apparatus is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness, and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries, and principles of the invention, the manner in which the electronic article surveillance security system is constructed and used, the characteristics of the construction, and the advantageous new and useful results obtained; the new and useful structures, devices, elements, arrangements, parts, and combinations are set forth in the appended claims.

I claim:

1. A security device affixable to a package to be protected against theft, said security device comprising:

a cable;

a housing attached to said cable, said housing having an entry port and an exit port;

a locking mechanism carried by said housing between said entry port and said exit port;

a strap attached to said cable, said strap having at least one tooth for selective interaction with said locking mechanism, said strap being selectively insertable within said housing in the direction from said entry port to said exit port; said strap being selectively prohibited from removal from said housing once said at least one tooth operatively engages said locking mechanism; and a crossover connector having a pair of passages, said cable extending through both of said passages to carry said crossover connector between said housing and said strap.

2. The security device as set forth in claim 1 in which said locking mechanism contains a channel including said entry port and said exit port.

3. The security device as set forth in claim 2 in which said locking mechanism contains at least a first finger protruding into said channel for interaction with said at least one tooth, each said finger allowing insertion of said strap while selectively preventing removal of said strap.

4. The security device as set forth in claim 3 in which each said finger is moveable between a locked position and an unlocked position, said strap being removable from said housing when each said finger is in said unlocked position.

5. The security device as set forth in claim 4 in which said housing is formed with an opening corresponding with each said finger.

6. The security device as set forth in claim 4 in combination with a key having a pin for each said finger, said housing formed with an opening for each said pin, said openings configured such that said pins can be simultaneously slidably received in said openings.

7. The security device as set forth in claim 6 in which said pins have a length sufficient to engage said fingers and to depress said fingers from said locked position to said unlocked position when said pins are inserted into said openings.

8. The security device as set forth in claim 7 in which said housing comprises a base and cover.

9. The security device as set forth in claim 8 in which said locking mechanism is hingedly attached to said base.

10. The security device as set forth in claim 9 in which said cable forms a closed loop to one side of said crossover connector opposite the ends of said cable.

11. The security device as set forth in claim 10 in which the ends of said cable are attached to said housing and said closed loop is attached to said strap.

12. The security device as set forth in claim 1 further comprising a key that selectively engages said locking mechanism and disengaging said at least one tooth from said locking mechanism.

13. The security device as set forth in claim 3 further comprising a key having a pin corresponding with each said finger, said pins selectively deflecting said fingers from a first undeflected position to a second deflected position, said at least one tooth operatively disengaged from said fingers when said fingers are in said second deflected position, said strap selectively removable from said housing when said fingers are in said second deflected position.

* * * * *